US006951385B2

(12) United States Patent
Wanibe

(10) Patent No.: US 6,951,385 B2
(45) Date of Patent: Oct. 4, 2005

(54) LIQUID EJECTING HEAD AND METHOD OF MANUFACTURING FLOW PATH FORMING PLATE IN USE OF LIQUID EJECTING HEAD

(75) Inventor: Akihisa Wanibe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 59 days.

(21) Appl. No.: 10/384,793

(22) Filed: Mar. 11, 2003

(65) Prior Publication Data

US 2004/0135840 A1 Jul. 15, 2004

(30) Foreign Application Priority Data

Mar. 11, 2002 (JP) ..... P2002-065032
Mar. 10, 2003 (JP) ..... P2003-062969

(51) Int. Cl.[7] ..... B41J 2/045
(52) U.S. Cl. ..... 347/68
(58) Field of Search ..... 347/68–72

(56) References Cited

U.S. PATENT DOCUMENTS 6,322,203 B1 * 11/2001 Kitahara ..... 347/70

FOREIGN PATENT DOCUMENTS

| | | | |
|---|---|---|---|
| JP | 05-318723 | A | 12/1993 |
| JP | 07-178909 | A | 7/1995 |
| JP | 10-202877 | A | 8/1998 |
| JP | 2000-108352 | A | 4/2000 |
| JP | 2001-179991 | A | 7/2001 |
| JP | 2001-277496 | A | 10/2001 |

* cited by examiner

*Primary Examiner*—Stephen D. Meler
*Assistant Examiner*—An H. Do
(74) *Attorney, Agent, or Firm*—Sughrue Mion, PLLC

(57) ABSTRACT

A liquid ejecting head includes a nozzle plate formed with a plurality of nozzle orifices; a flow path forming plate, formed with a plurality of pressure chambers which communicate with the nozzle orifices respectively, a reservoir which stores liquid therein, and a plurality of liquid flow paths which communicate the pressure chambers with the reservoir respectively; an elastic plate, applying pressure to the liquid in the pressure chambers; and a plurality of driver elements, each pushing the elastic plate so as to vary a volume of each corresponding pressure chamber. The flow path forming plate is comprised of (110) orientation silicon single crystal. A liquid flow path wall partitioning adjacent liquid flow paths and a pressure chamber wall partitioning adjacent pressure chambers are formed continuously. A width of the liquid flow path wall is greater than that of the pressure chamber wall.

9 Claims, 9 Drawing Sheets

LIQUID EJECTING HEAD AND METHOD OF MANUFACTURING FLOW PATH FORMING PLATE IN USE OF LIQUID EJECTING HEAD

BACKGROUND OF THE INVENTION

The present invention relates to a liquid ejecting head which ejects a liquid droplet by varying a volume of a pressure generating chamber by a piezoelectric vibrator, and particularly to the structure of a flow path forming plate constituting the liquid ejecting head.

A liquid ejecting head such as a printing equipment, a microdispenser, and a commercial recording apparatus which requires printing of very high quality, as disclosed in JP-A-2001-277496, is constituted so that a reservoir is formed as a recess portion by full etching and a liquid supply path is formed as a recess portion by half etching.

In case that flow paths are thus formed using full etching and half etching, there are two steps including of firstly full etching an area to be a through-hole, and thereafter half etching an area to be a recess portion.

Therefore, since an etching-resistant layer is not formed on a vertical face (a face vertical to a surface of a plate) exposed by full etching, the vertical face receives etching very easily compared with etching in the vertical direction, and a wall partitioning liquid supply paths which communicates each pressure generating chamber with a reservoir is retreated more on the pressure generating chamber side than on an end of a wall defining the reservoir, so that there is such a disadvantage that function of discharge of air bubble is deteriorated.

SUMMARY OF THE INVENTION

It is therefore an object of the present invention to provide a liquid ejecting head which can surely discharge air bubbles intruding a reservoir.

Another object of the invention is to provide a method of manufacturing a flow path forming plate in use of a liquid ejecting head.

In order to achieve these objects, a liquid ejecting head of the invention comprises:

a nozzle plate, formed with a plurality of nozzle orifices;

a flow path forming plate, formed with a plurality of pressure chambers which communicate with the nozzle orifices respectively, a reservoir which stores liquid therein, and a plurality of liquid flow paths which communicate the pressure chambers with the reservoir respectively;

an elastic plate, applying pressure to the liquid in the pressure chambers; and a plurality of driver elements, each pushing the elastic plate so as to vary a volume of each corresponding pressure chamber, wherein the flow path forming plate is comprised of (110) orientation silicon single crystal;

wherein a liquid flow path wall partitioning adjacent liquid flow paths and a pressure chamber wall partitioning adjacent pressure chambers are formed continuously; and wherein a width of the liquid flow path wall is greater than that of the pressure chamber wall.

Preferably, the pressure chambers are arranged with each other in parallel, and have a predetermined length. The reservoir is extended in a longitudinal direction of the reservoir parallel with an arranged direction of the pressure chambers. An edge portion of the reservoir in the longitudinal direction is away from the pressure chamber. The liquid flow path wall of the liquid flow path which communicates to the pressure chamber corresponding to the edge portion of the reservoir has a first wall portion and the second wall portion. The first wall portion is disposed at a reservoir side, and the second wall portion is disposed at a pressure chamber side. A width of the first wall portion is smaller than that of the second wall portion.

Here, it is preferable that, an island shaped portion is provided on each liquid flow path so as to extend within the liquid flow path defined by the second wall portion of the liquid flow path wall.

According to the present invention, there is also provided a liquid ejecting head comprising:

a nozzle plate, formed with a plurality of nozzle orifices;

a flow path forming plate, formed with a plurality of pressure chambers which communicate with the nozzle orifices respectively, a reservoir which stores liquid therein, and a plurality of liquid flow paths which communicate the pressure chambers with the reservoir respectively;

an elastic plate, applying pressure to the liquid in the pressure chambers; and a plurality of driver elements, each pushing the elastic plate so as to vary a volume of each corresponding pressure chamber, wherein the flow path forming plate is comprised of (110) orientation silicon single crystal;

wherein a liquid flow path wall partitioning adjacent liquid flow paths and a pressure chamber wall partitioning adjacent pressure chambers are formed continuously;

wherein an island shaped portion is provided on each liquid flow path;

wherein a first end portion of the island shaped portion is closer to the reservoir than a second end portion of the liquid flow path wall; and wherein the first end portion is disposed at a reservoir side, and the second end portion is disposed at the reservoir side.

In the above constitution, since the wall partitioning the liquid flow paths, or the end portion of the island shaped portion is close to the end portion of the wall defining the reservoir, the negative pressure given from the nozzle orifice can be concentrated on the wall of each liquid flow path to be applied to air bubbles, and the air bubbles can be removed readily through the liquid flow path and the pressure generating chamber from the nozzle orifice.

Further, in the above constitution, in case that a length of the liquid flow path becomes larger at the end region of the reservoir, with fluid resistance and inertance of the liquid flow path kept at the predetermined value, a bonding region in the liquid flow path of the flow path forming plate can be secured fully.

DESCRIPTION OF THE PREFERRED EMBODIMENTS

The invention will be described below in detail with reference to shown embodiments.

Figure 1:
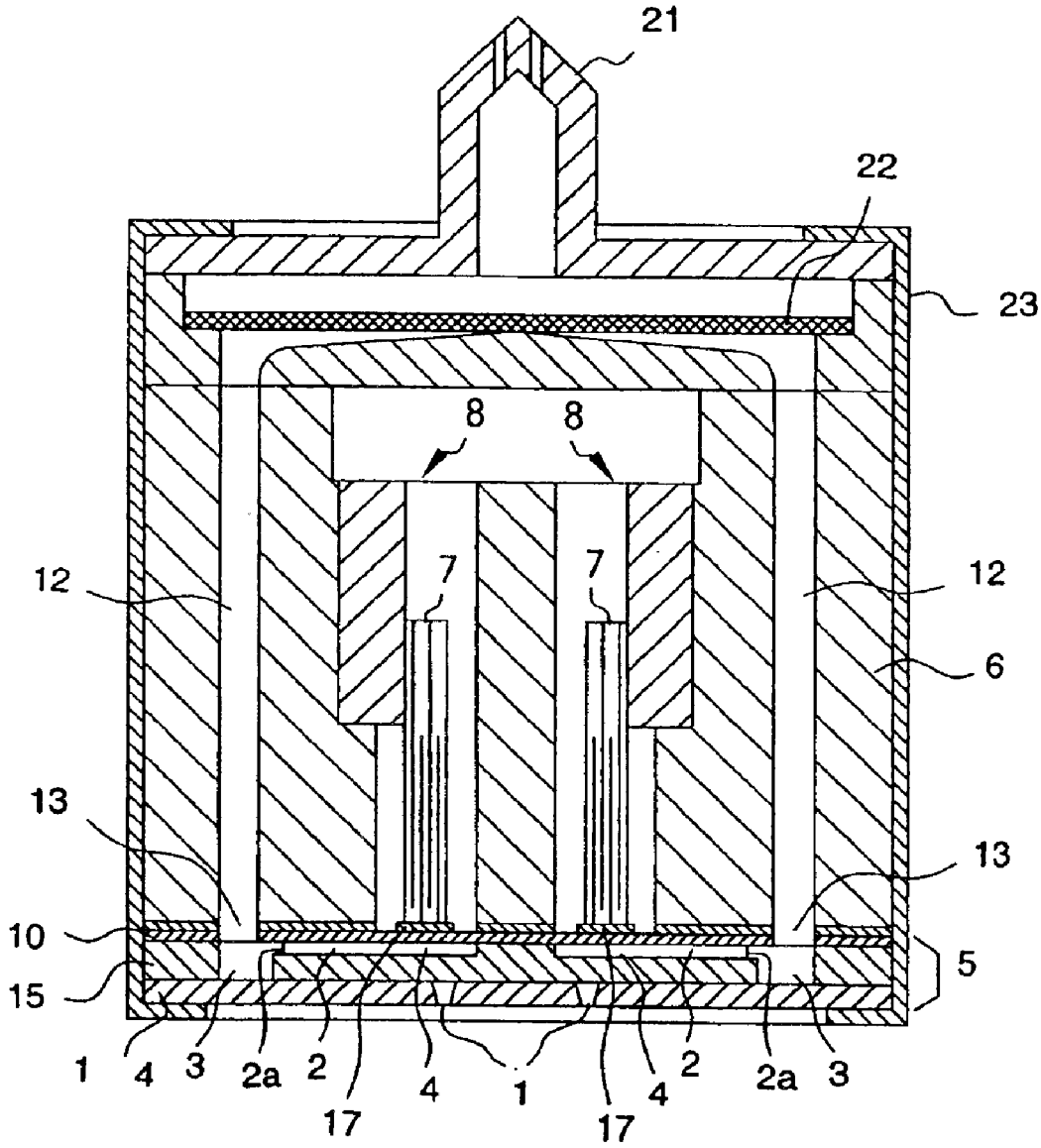
FIG. 1 is a sectional view showing a liquid ejecting head according to one embodiment of the invention.

FIG. 1 shows one embodiment of an ink jet recording head that is one type of liquid ejecting head of the invention, in which a flow path forming unit 5 forming nozzle orifices 1, liquid flow paths 2, reservoirs 3 and pressure generating chambers 4 is fixed onto one end of a head holder 6, and piezoelectric vibrator units 8 are fixed to the head holder 6 so that leading ends of piezoelectric vibrators 7 come into contact this flow path forming unit 5 in positions opposed to the pressure generating chambers 4 in each row.

Figure 2:
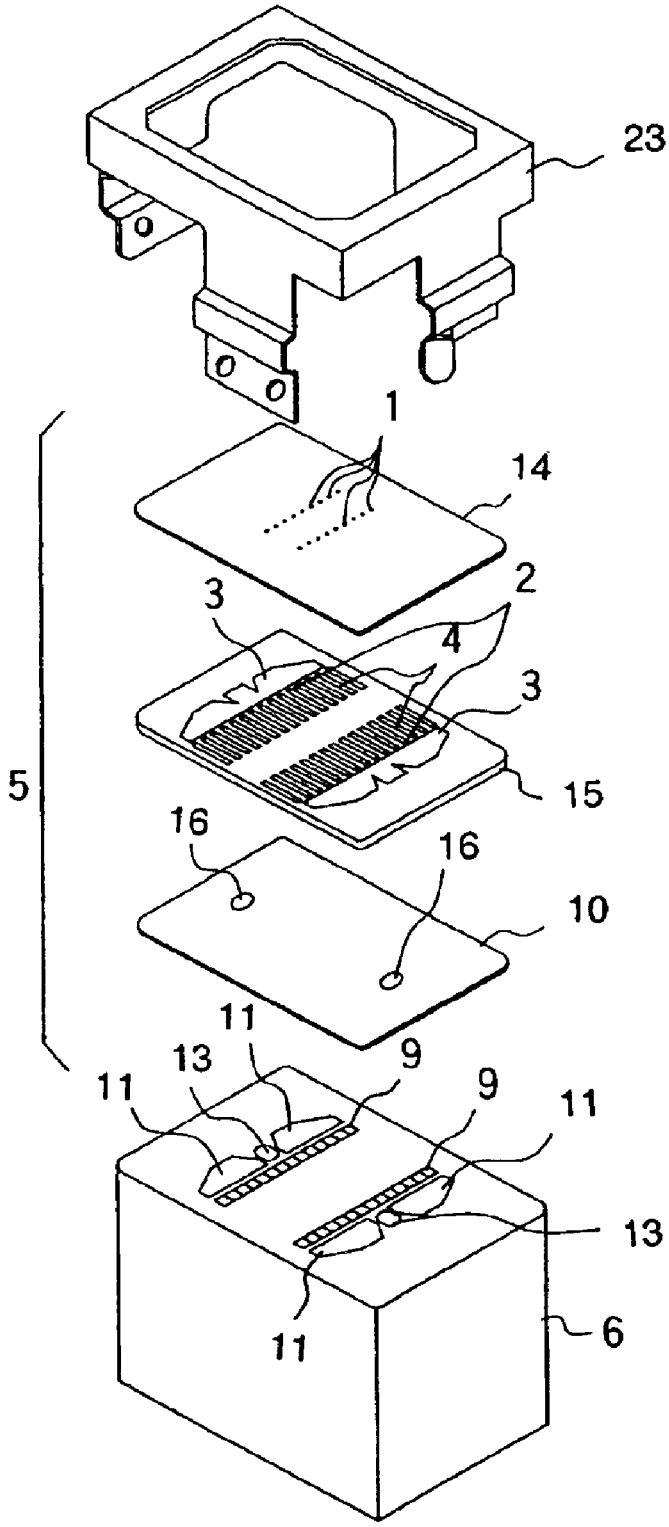
FIG. 2 is a perspective view in assembly of the liquid ejecting head of the invention.

In the head holder 6, as shown in FIG. 2, windows 9 from which the piezoelectric vibrators 7 are exposed are formed in positions opposed to the pressure generating chambers 4. Also, recess portions 11 that can deform elastically a seal plate 10 that is elastically deformable by the piezoelectric vibrator 7 are formed at regions opposed to the reservoirs 3. Further, an opening 13 is formed at a leading end of a liquid guiding path 12 in position opposed to a center of the reservoir 3.

The flow path forming unit 5 includes a nozzle plate 14 provided with the nozzle orifices 1 communicating with the pressure generating chambers 2; a spacer 15 forming the reservoirs 3, the liquid flow paths 2, and the pressure generating chambers 4; and a seal plate 10 that seals at least the reservoirs 3, the liquid flow paths 2 and the pressure generating chambers 4 and has liquid guide inlets 16 each connecting the opening 13 of the head holder 6 and the reservoir 3 to elastically deformable elastic film at the regions of the reservoirs and the pressure generating chambers 4, which are laminated in a sandwich manner.

In the seal plate 10, in this embodiment, in order to convert displacement of the piezoelectric vibrator 7 into volume change of the pressure generating chamber, an island portion 17 having rigidity is formed on a center line of each pressure generating chamber.

Figure 3:
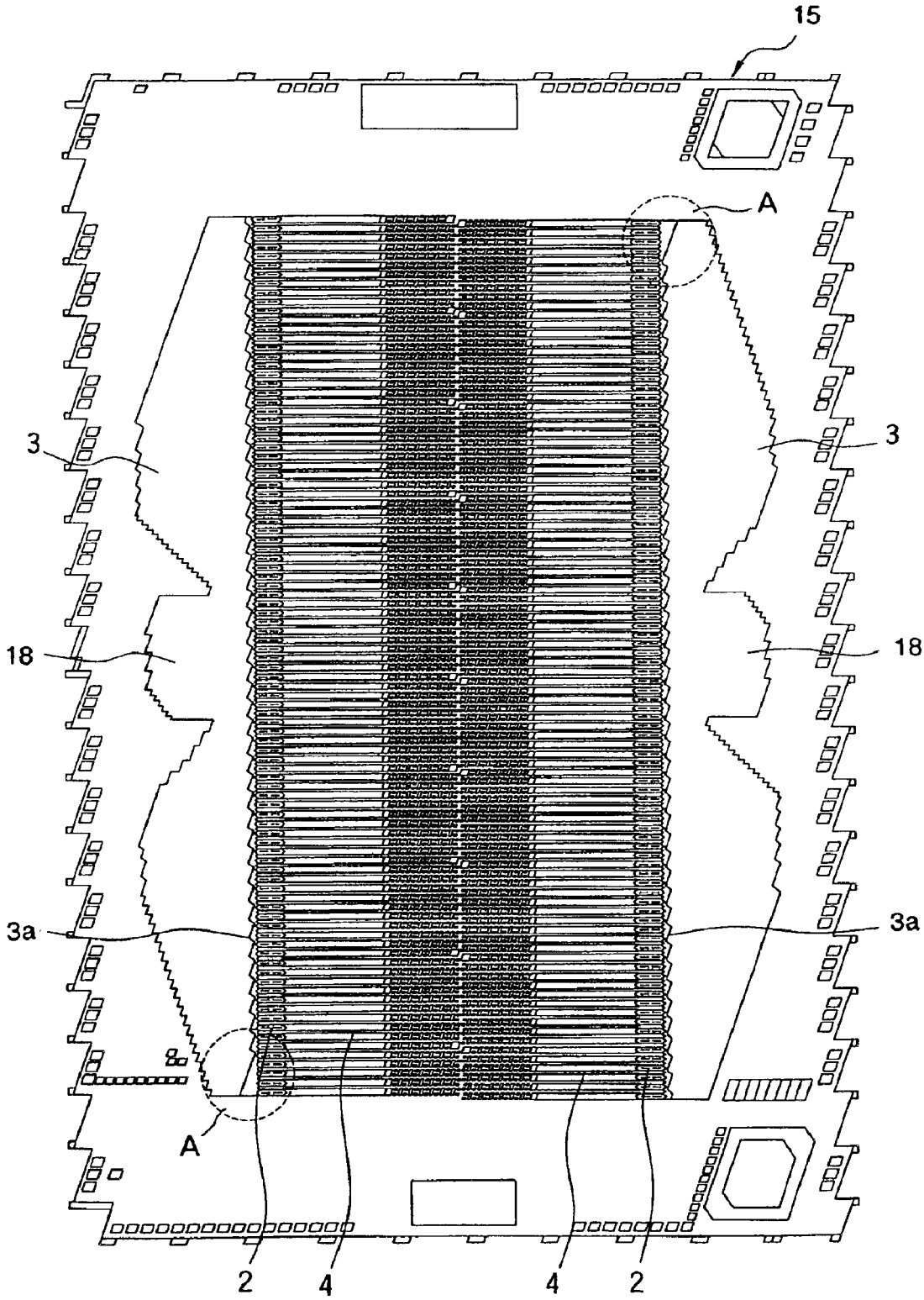
FIG. 3 is a plan view showing a spacer according to one embodiment.

FIG. 3 shows one embodiment of the spacer 15 forming the flow path forming plate. The spacer 15 is composed of material on which a pattern formed by photolithography can be chemically etched, for example, metal or silicon single crystal plate. In this embodiment, the silicon single crystal plate having a thickness suitable to constitute the spacer is used. The pressure generating chambers 4 are formed at the predetermined pitch in two rows so as to have a center line of the spacer 15 as a symmetrical line. The reservoirs 3 are independently formed respectively on the outsides of the liquid flow paths 2 of each row. The reservoir 3 is connected through the liquid flow paths 2 to the pressure generating chambers 4 of each row.

A bottom portion of the liquid flow path 2 is formed more shallowly than that of the reservoir 3 in the invention, and the liquid flow path 2 is extended as close to a vertical wall defining the reservoir 3 as possible so as to continue from a wall partitioning each pressure generating chamber 4.

Figure 4A:
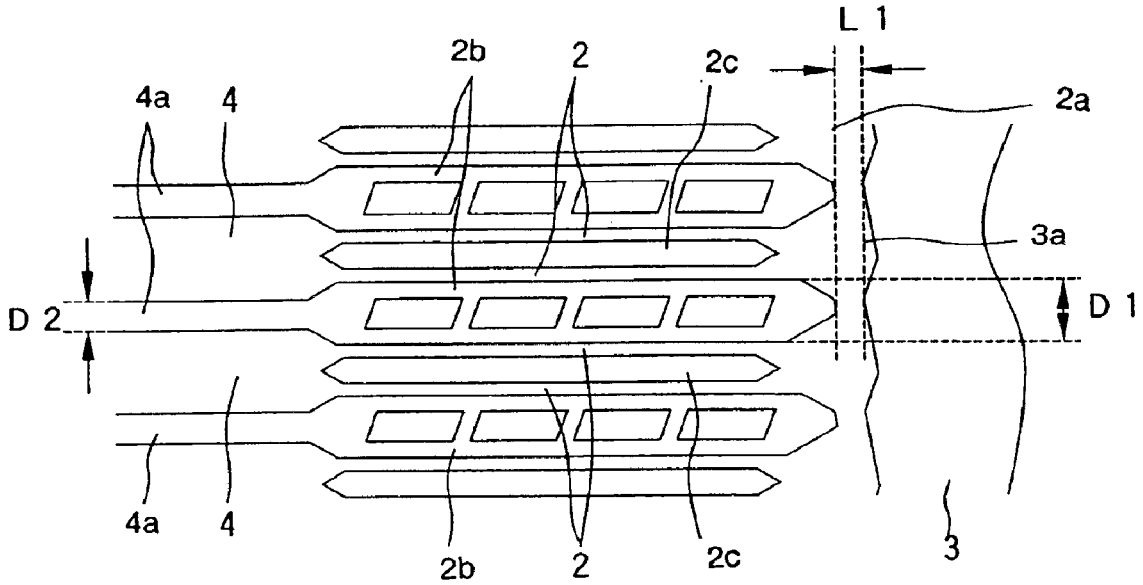
FIG. 4A is a top view showing the structure in the vicinity of a leading end of a liquid flow path in a flow path forming plate constituting the liquid ejecting head of the invention.
Figure 4B:
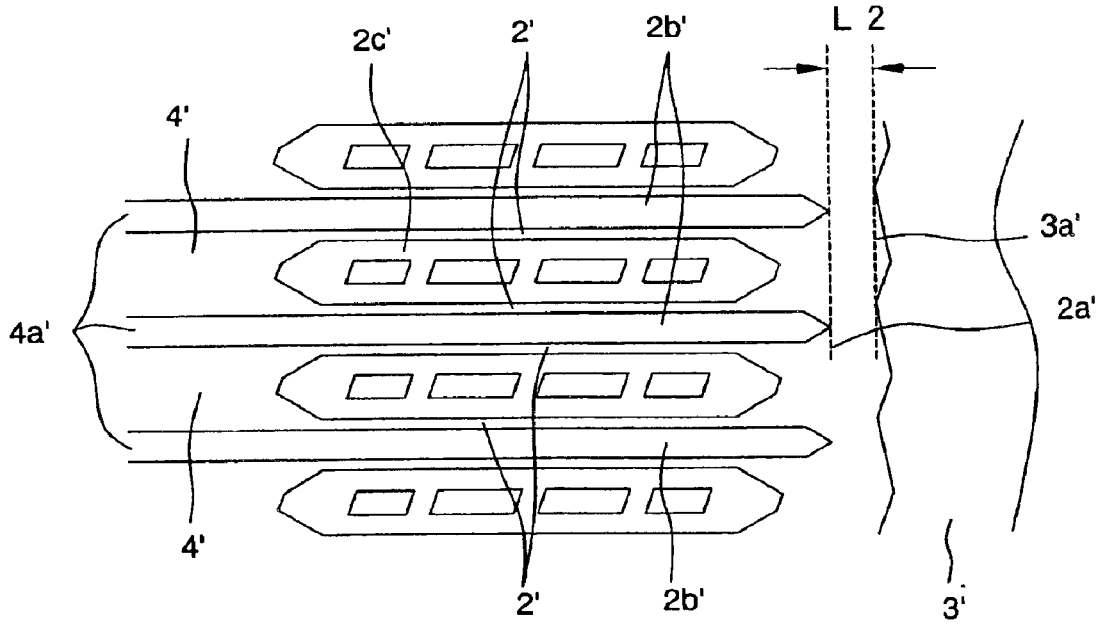
RELATED ART FIG. 4B
FIG. 4B is a top view showing the structure in the vicinity of a leading end of a liquid flow path in a flow path forming plate constituting a related liquid ejecting head.

Namely, as shown in FIG. 4A, a distance L1 between a leading end 2*a* of the liquid flow path 2 and a vertical wall 3*a* defining the reservoir 3 is set shorter than a distance L2 between a leading end 2*a*' of a liquid flow path 2' in a related flow path forming plate shown in FIG. 4B and a vertical wall 3*a*' defining a reservoir 3'.

In order to thus make the distance L1 shorter, a wall 2*b* partitioning the liquid flow paths 2 in the flow path forming plate of the invention is set greater in width than a wall 4*a* partitioning the pressure generating chambers 4. A wall 2*b*' partitioning the liquid flow paths 2' in the related flow path forming plate is equal in width to a wall 4*a*' partitioning pressure generating chambers 4'.

In this embodiment, the nozzle plate 14 is fixed on one surface of the spacer 15 and the seal plate 10 is fixed on the other surface thereof closely with adhesive, whereby the flow path forming unit 5 is constituted.

After the liquid guide inlet 16 in this flow path forming unit 5 and the opening 13 of the liquid guiding path 12 in the head holder 6 are aligned with each other, the flow path forming unit 5 is fixed to the head holder 6 with the adhesive; the piezoelectric vibrator unit 8 is fixed to the head holder 6 so that the leading end of the piezoelectric element 7 comes into contact with the island portion 17 of the seal plate 10; a liquid supply needle 21 and a filter 22 are attached onto the other surface of the head holder 6; and the outside of them is fixed by a frame 23 served as a shield member, whereby a liquid ejecting head is completed.

When a drive signal is applied to thus constituted liquid ejecting head, the piezoelectric vibrator 7 is contracted so as to expand the pressure generating chamber 4. Hereby, the liquid stored in the reservoir 3 flows into the pressure generating chamber 4 through the liquid flow path 2. When the piezoelectric vibrator 7 is discharged after the predetermined time elapses, it elongates and returns to the initial state. In this process, the pressure generating chamber 4 is contracted and the liquid in the pressure generating chamber 4 is ejected from the nozzle orifice 1 as a liquid droplet.

On the other hand, in case that air bubbles is entered the liquid ejecting head in exchange of a liquid cartridge, a front surface of the nozzle plate 14 is sealed by a cap and negative pressure from a suction pump is applied to perform a filling operation.

The negative pressure applied to this nozzle orifice 1 is transmitted from the pressure generating chamber 4 communicating with the corresponding nozzle orifice 1 to the liquid flow path 2, and the liquid in the reservoir 3 is exhausted from the leading end 2*a* of the liquid flow path 2 through the pressure generating chamber 4 to the nozzle orifice 1.

Figure 5A:
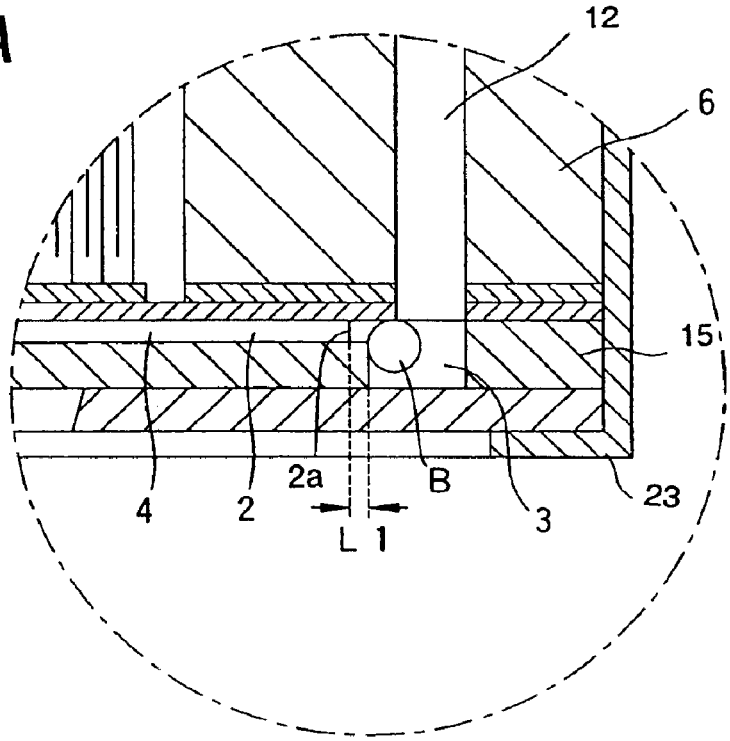
FIG. 5A is a diagram showing a position of an air bubble in the vicinity of the leading end of the liquid flow path in the liquid ejecting head of the invention.

At this time, since the leading end 2*a* of the liquid flow path 2 is close to the vertical wall 3*a* defining the reservoir 3, as shown in FIG. 5A, an air bubble B can approach near the leading end 2*a* of the liquid flow path 2 readily, whereby the negative pressure B applied to the liquid flow path 2 acts on the air bubble directly and the air bubble is readily absorbed in the pressure generating chamber 2.

Figure 5B:
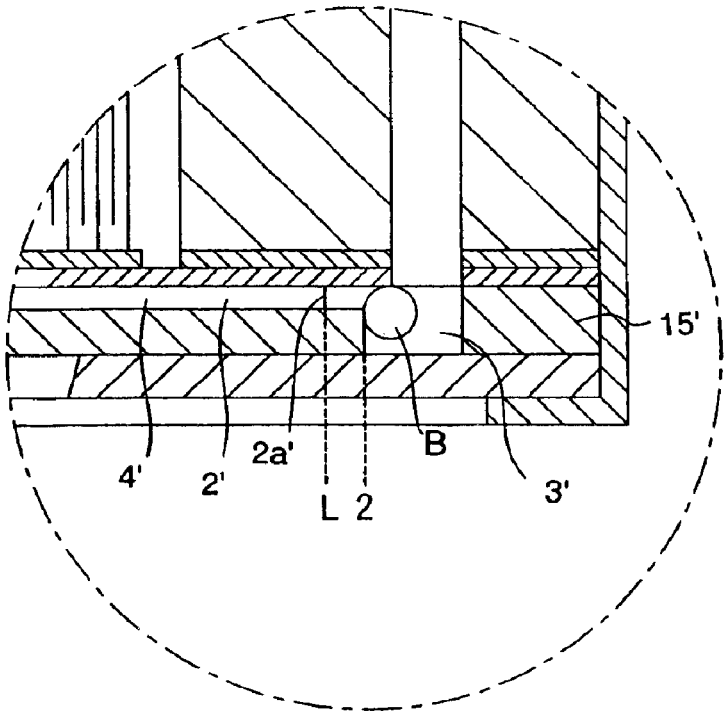
RELATED ART FIG. 5B
FIG. 5B is a diagram showing a position of an air bubble in the vicinity of a leading end of a liquid flow path in a related liquid ejecting head.

On the contrary, in the related liquid ejecting head, as shown in FIG. 5B, since the distance L2 between the leading end 2*a*' of the liquid flow path 2' and the vertical wall 3*a*' defining the reservoir 3' is great, the air bubble B is interrupted by the wall 3*a*' of the reservoir 3', and the liquid flows between the air bubble B and the leading end 2*a*' of the liquid flow path 2', so that it is difficult to remove the air bubble B.

Next, a method of manufacturing the flow path forming plate 15 of the invention by anisotropic etching a silicon single crystal plate will be described.

Figure 6:
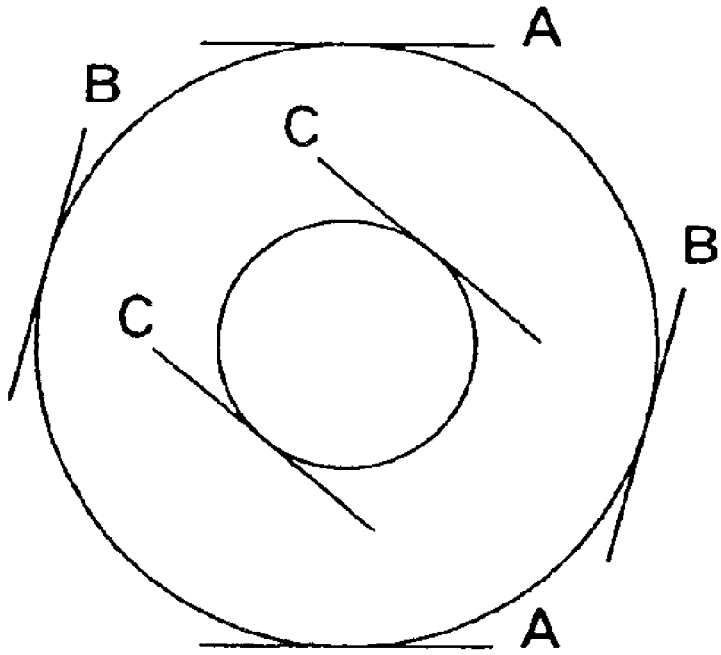
FIG. 6 is an explanatory view showing etching directions of a silicon single crystal plate.

As disclosed in JP-A-10-202877, in case that a silicon single crystal plate is anisotropically etched to form ink flow paths such as a pressure generating chamber, a liquid flow path, and a reservoir, a (110) orientation silicon single crystal plate is cut out so as to obtain a thickness suitable for a flow path forming plate. As shown in FIG. 6, in faces A, B, and C which appear in case that a (110) face is anisotropically etched, grid directions <111> which are vertical to the (110) face (faces shown by lines A and B in FIG. 6. A face shown by a line C forms an angle of about 35 degrees with a surface of the (110) face.) are taken as a first direction and a second direction. Pressure generating chambers each including a recess portion are formed in two rows so that an axis in the longitudinal direction of each pressure generating chamber becomes parallel to the first direction, and their arrangement direction becomes parallel to the second direction. Next, a reservoir which supplies ink to these pressure generating chambers is formed so as to become a recess portion having the shape of an approximate parallelogram of which a long side is parallel to the second direction and of which a short side becomes parallel to the first direction. Further, liquid flow paths which connect each pressure generating chamber to the reservoir are formed in the same direction as the pressure generating chamber.

Figure 7A:
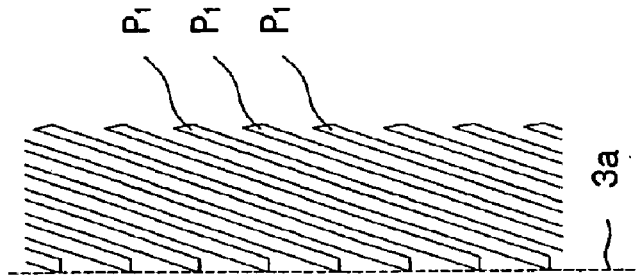
FIG. 7A is a diagram showing a liquid flow path side pattern of a reservoir wall in a full etching pattern used in manufacture of the flow path forming plate constituting the liquid ejecting head of the invention.

In the invention, in order to approach the vertical wall 3*a* on the liquid flow path 2 side, defining the reservoir 3 to the leading end 2*a* on the reservoir 3 side of the liquid flow path 2 as much as possible, an auxiliary pattern P1 is formed on a pattern which becomes the vertical wall 3*a* of the reservoir 3, as shown in FIG. 7A. Hereby, after the reservoir 3 is formed by full etching, a plurality of elongate non-etched portions corresponding to the auxiliary pattern P1 is remained.

Figure 7B:
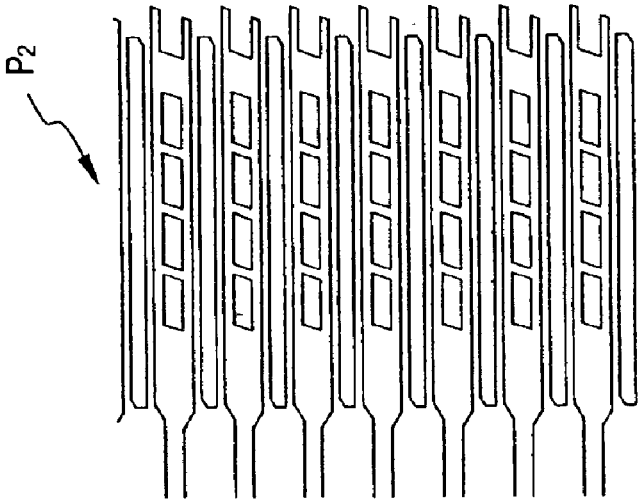
FIG. 7B is a diagram showing a reservoir side pattern in a half etching pattern used in manufacture of the flow path forming plate constituting the liquid ejecting head of the invention.
Figure 7C:
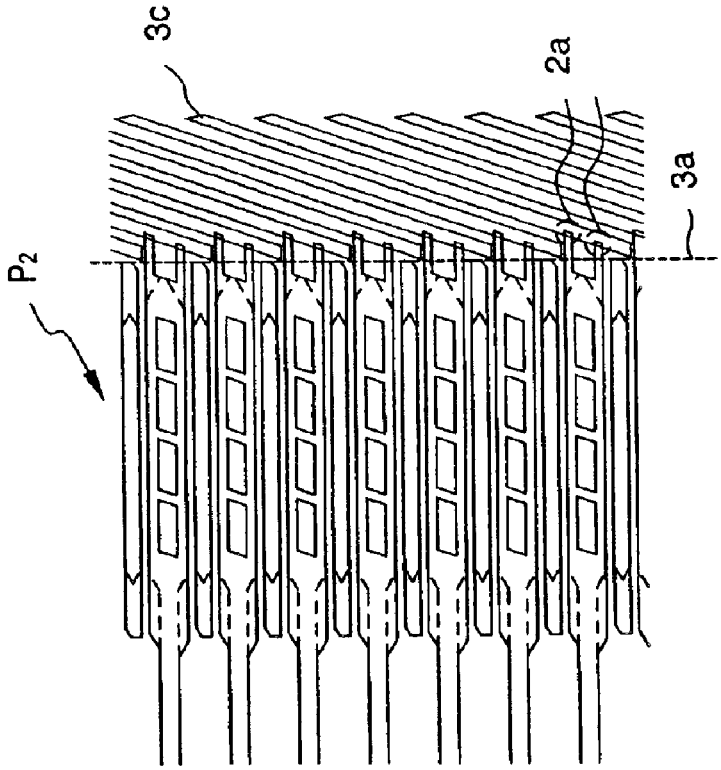
FIG. 7C is a diagram showing a mutuality between the pattern shown in FIG. 7A and the pattern shown in FIG. 7B.

In this state, a liquid flow path 2 and a pressure generating chamber 4 are formed by a second etching pattern P2 shown in FIG. 7B. When half-etching is performed in a state where the leading end 2*a* of the liquid flow path 2 in the pattern P2 nearly coincides with the vertical wall 3*a* of the reservoir 3 in the plural elongate non-etched portions 3*c* formed by the pattern P1 as shown in FIG. 7C, the leading end 2*a* of the liquid flow path 2 is etched with the plural elongate non-etched portions 3*c*. Therefore, even if a vertical face of the leading end 2*a* of the liquid flow path 2 is not protected by an etching resistant layer, this non-etched portion 3*a* is also etched, so that retreat of the wall 2*b* partitioning the liquid flow paths 2 is prevented as much as possible, and the liquid flow path 2 can be formed with its leading end 2*a* approached to the wall 3*a* defining the reservoir 3. A dotted lines in FIG. 7C shows an end position of etching.

Figure 8A:
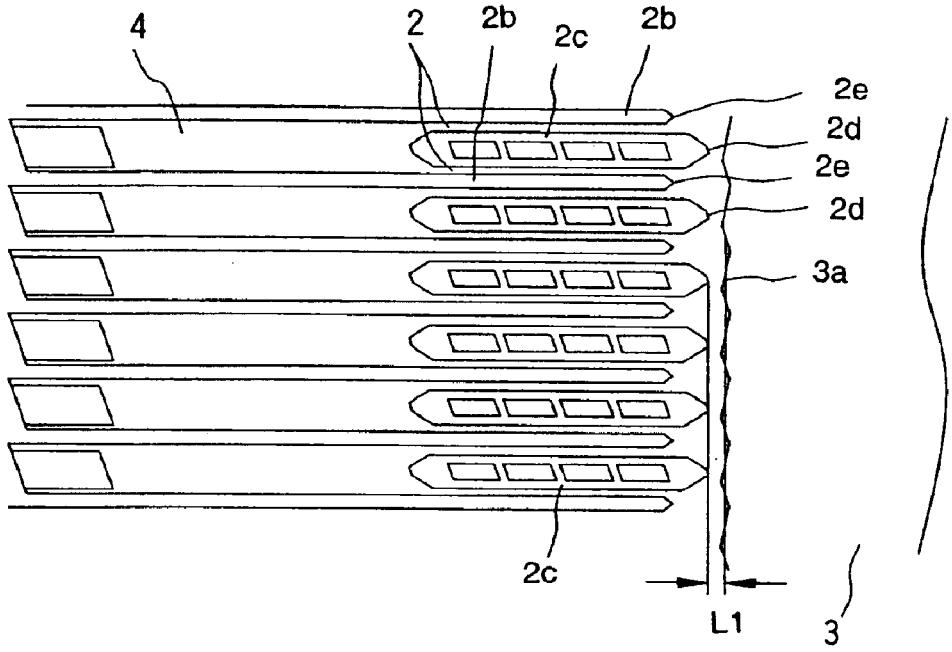
FIG. 8A is a top view showing the structure in the vicinity of a leading end of a liquid flow path in a flow path forming plate constituting a liquid ejecting head according to another embodiment.
Figure 8B:
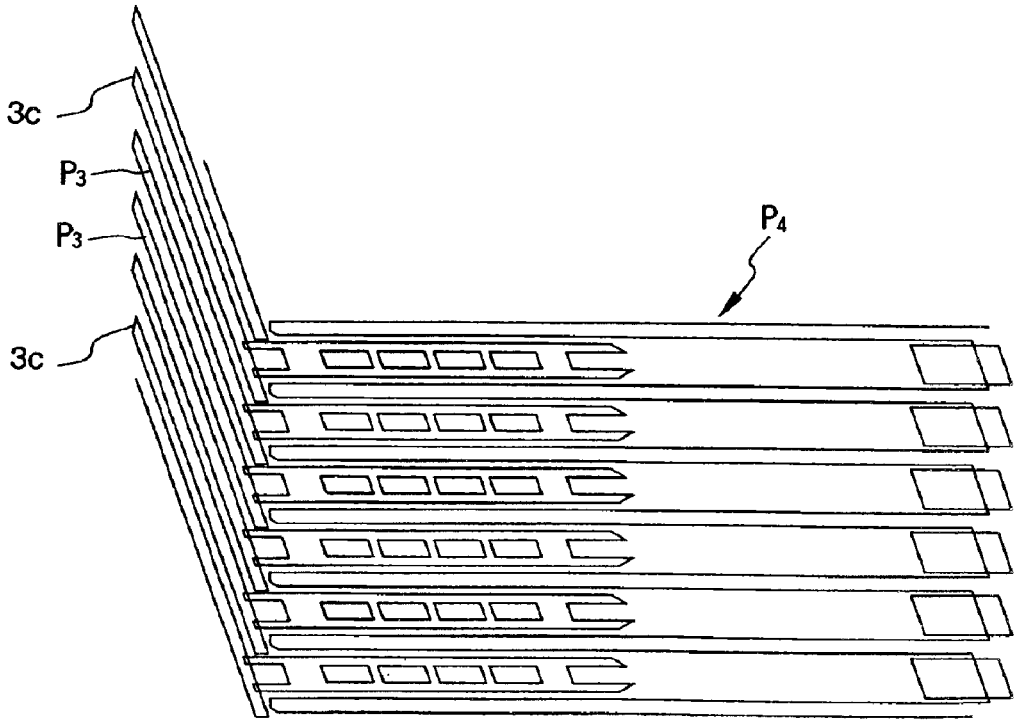
FIG. 8B is a diagram in which a liquid flow path side pattern of a reservoir wall in a full etching pattern used in manufacture of a flow path forming plate according to another embodiment of the invention is overlapped with a reservoir side pattern in a half etching pattern.

In the above embodiment, the wall partitioning the liquid flow paths is so constituted as to protrude to the reservoir side. However, also in case that an end portion 2*d* on a reservoir side of an island shaped portion 2*c* for narrowing down the flow path of the liquid flow path is extended to the reservoir side as shown in FIG. 8A, the similar advantage is obtained.

Namely, since the negative pressure of the liquid flow path is applied between the end portions 2*d* on the reservoir side of the island shaped portions 2*c* isolated in the adjacent plural flow paths, the air bubbles caught at the end portions 2*d* on the reservoir side of these island shaped portions 2*c* can be readily pulled into the pressure generating chambers to be exhausted from the nozzle orifices.

When half-etching is performed in a state where the leading end 2*d* of the island shaped portions 2*c* in a pattern P4 forming the liquid flow path 2 and the pressure generating chamber 4 nearly coincides with the vertical wall 3*a* of the reservoir 3 in the plural elongate non-etched portions formed by a pattern P3 similar to the auxiliary pattern P1 (FIG. 7A), retreat of the island shaped portion 2*c* is prevented as much as possible, so that these flow paths can be formed with the leading end 2*c* of the island shaped portion approached to the wall 3*a* defining the reservoir 3.

When the pressure generating chambers 4 are arranged up to a region A where the end of the wall of the reservoir 3 is more distant from the nozzle orifice linearly as shown in FIG. 3, and the end portion of the liquid flow path is approached to the wall of the reservoir as much as possible in order to improve removability of air bubbles, since the nozzle orifices are located on the straight line, and the length in the longitudinal direction of the pressure generating chambers are constant, the end portion on the reservoir side of the liquid flow path at the region A is elongated necessarily, that is, a flow path length of the liquid flow path becomes longer.

Consequently, fluid resistance and fluid inertance of the liquid flow path at the end region A become larger those of the liquid flow path of the pressure generating chamber at another region. In result, since characteristic of supplying liquid to the pressure generating chambers at the end region A becoming more distant linearly is different from that at another region, ejection characteristic of liquid droplet changes at the end region A.

Figure 9A:
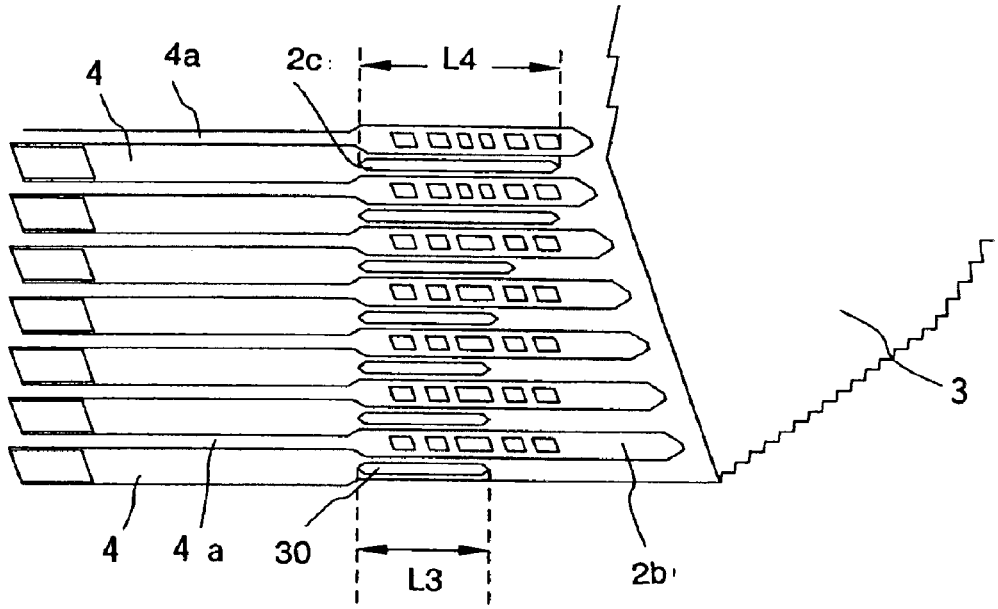
FIG. 9A is a diagram showing one embodiment of the liquid flow path at an end region of the reservoir in the top structure of a spacer.

As countermeasure of increase of the fluid resistance and inertance of the liquid flow path at such the end region, as shown in FIG. 9A, it is thought that a length L3 of an island shaped portion 30 formed in the liquid flow path at the end region A becoming more distant linearly is made shorter than a length L4 of an island shaped portion 2*c* at another region.

However, since these pressure generating chamber and liquid flow path are formed in the spacer 15 as a recess part, and the seal plate 10 is adhered to these opening surfaces, the above countermeasure makes small an adherable region in the liquid flow path region. Namely, as the length of the island shaped portion 2*c* becomes smaller, the bonding area becomes also smaller.

Since the fluid resistance and inertance of the liquid flow path affect greatly flow of liquid to be supplied to the pressure generating chamber 4, it is necessary to fix the region sealing the liquid flow path, in the seal plate 10 to the spacer 15 as closely as possible to keep the sectional area of the liquid flow path at a design value.

Figure 9B:
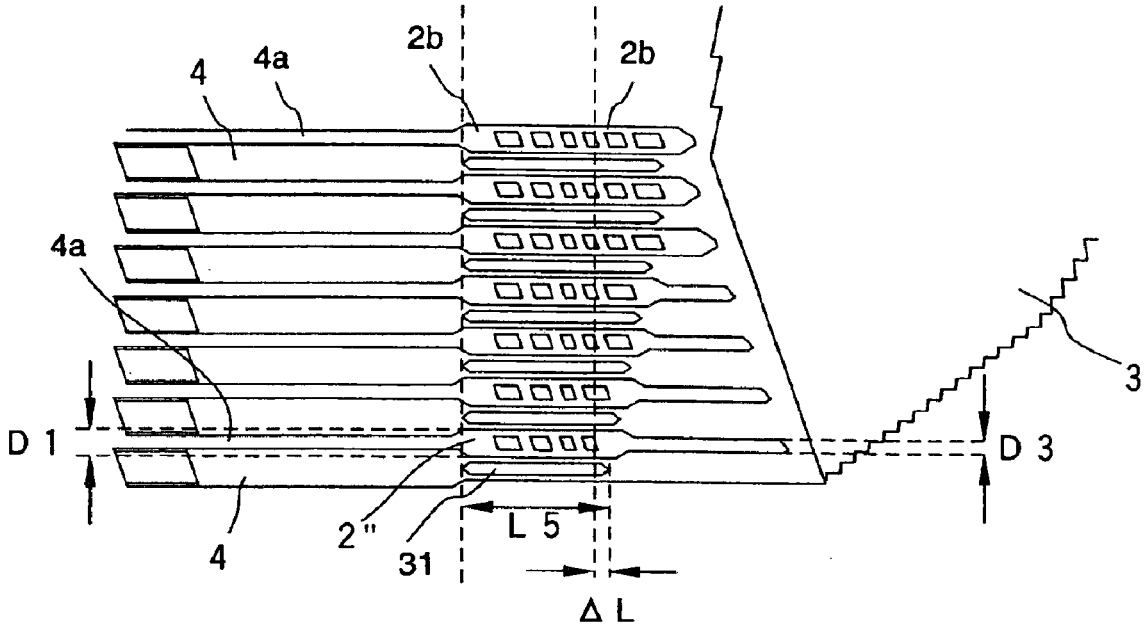
FIG. 9B is a diagram showing another embodiment of the liquid flow path at an end region of the reservoir in the top structure of the spacer.

FIG. 9B shows one embodiment for solving this problem. In this embodiment, in the partition walls 2*b* in the embodiment shown in FIG. 4A, a width D3 on reservoir side of a partition wall 2 located at the end region A of the reservoir which becomes more distant from the nozzle orifice linearly is made smaller for decreasing the fluid resistance and inertance affected by the width of the partition wall 2*b*. On the contrary, an island shaped portion 31 is made longer than the island shaped portion 30 in FIG. 9A by $\Delta L = L5 - L3$, whereby the fluid resistance and inertance suitable to supply the liquid to the pressure generating chamber 4 are secured. In result, adhesive power of the seal plate at the region of the liquid flow path is improved, and the liquid ejection characteristic at the end region is made the same as that at another region, so that print quality is improved.

Further, in the liquid flow path, since the flow path resistance on the pressure generating chamber 4 side is raised and that on the reservoir side is lowered to keep the whole balance, the volume of the pressure generating chamber can be kept constant and degradation of pressure efficiency can be prevented.

What is claimed is:

1. A liquid ejecting head comprising:

a nozzle plate, formed with a plurality of nozzle orifices;

a flow path forming plate, formed with a plurality of pressure chambers which communicate with the nozzle orifices respectively, a reservoir which stores liquid therein, and a plurality of liquid flow paths which communicate the pressure chambers with the reservoir respectively;

an elastic plate, applying pressure to the liquid in the pressure chambers; and a plurality of driver elements, each pushing the elastic plate so as to vary a volume of each corresponding pressure chamber, wherein the flow path forming plate is comprised of (110) orientation silicon single crystal;

wherein a liquid flow path wall partitioning adjacent liquid flow paths and a pressure chamber wall partitioning adjacent pressure chambers are formed continuously; and wherein a width, of the liquid flow path wall is greater than that of the pressure chamber wall.

2. The liquid ejecting head as set forth in claim 1, wherein an island shaped portion is provided in each of the liquid flow paths so as to adjust flow path resistance in each of the liquid flow paths.

3. The liquid ejecting head as set forth in claim 1, wherein an island shaped portion is provided in each of the liquid flow paths so as to separate each of the liquid flow paths into a plurality of sub liquid flow paths, wherein a first end portion of the liquid flow path wall is closer to the reservoir than a first end portion of the island shaped portion, and wherein the first end portion of the liquid flow path wall is disposed at a reservoir side, and the first end portion of the island shaped portion is disposed at the reservoir side.

4. The liquid ejecting head as set forth in claim 1, wherein the pressure chambers are arranged in parallel, and have a predetermined lengths, wherein the reservoir extends in an arrangement direction with respect to the pressure chambers, wherein an edge portion of the reservoir in the arrangement direction is away from the pressure chambers, wherein the liquid flow path wall has a first wall portion at a reservoir side and a second wall portion at a pressure chamber side, and wherein a width of the first wall portion is smaller than that of the second wall portion.

5. The liquid ejecting head as set forth in claim 4, wherein an island shaped portion is provided in each of the liquid flow paths so as to extend within each of the liquid flow paths, and wherein the second wall portion of the liquid flow path wall partitions the adjacent liquid flow paths.

6. The liquid ejecting head as set forth in claim 4, wherein the width of the first wall portion and the width of the second wall portion are measured along the arrangement direction.

7. A liquid ejecting head comprising:

a nozzle plate, formed with a plurality of nozzle orifices;

a flow path forming plate, formed with a plurality of pressure chambers which communicate with the nozzle orifices respectively, a reservoir which stores liquid therein, and a plurality of liquid flow paths which communicate the pressure chambers with the reservoir respectively;

an elastic plate, applying pressure to the liquid in the pressure chambers; and a plurality of driver elements, each pushing the elastic plate so as to vary a volume of each corresponding pressure chamber, wherein the flow path forming plate is comprised of (110) orientation silicon single crystal;

wherein a liquid flow path wall partitioning adjacent liquid flow paths and a pressure chamber wall partitioning adjacent pressure chambers are formed continuously;

wherein an island shaped portion is provided in each liquid flow path;

wherein a first end portion of the island shaped portion is closer to the reservoir than a first end portion of the liquid flow path wall; and wherein the first end portion of the island shaped portion is disposed at a reservoir side, and the first end portion of the liquid flow path wall is disposed at the reservoir side.

8. The liquid ejecting head as set forth in claim 7, wherein the island shaped portion provided in each of the liquid flow paths is provided so as to adjust flow path resistance in each of the liquid flow paths.

9. The liquid ejecting head as set forth in claim 7, wherein a width of the island shaped portion is greater than that of the liquid flow path wall.

* * * * *